US006382362B1

(12) United States Patent
Kutz

(10) Patent No.: US 6,382,362 B1
(45) Date of Patent: May 7, 2002

(54) OPTICAL MONITORING SYSTEM FOR HOISTWAY DOOR INTERLOCKS

(75) Inventor: David S. Kutz, Bedminster, NJ (US)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/782,547

(22) Filed: Feb. 13, 2001

(51) Int. Cl.[7] ..... B66B 13/06

(52) U.S. Cl. ..... 187/316; 187/335; 187/280

(58) Field of Search ..... 187/313, 315, 187/316, 317, 280, 289, 291, 331, 391, 393; 49/116, 120, 26, 28; 160/291, 292; 318/480

(56) References Cited

U.S. PATENT DOCUMENTS

| | | | | | |
|---|---|---|---|---|---|
| 3,054,475 | A | * | 9/1962 | Moser et al. | 187/316 |
| 3,652,312 | A | * | 3/1972 | Hutner | 187/316 |
| 4,009,767 | A | * | 3/1977 | Stadigh | 187/28 |
| 4,583,092 | A | * | 4/1986 | Naylor | 340/545 |
| 5,107,964 | A | * | 4/1992 | Coste et al. | 187/100 |
| 5,454,447 | A | * | 10/1995 | Kulak et al. | 187/331 |
| 5,487,448 | A | * | 1/1996 | Schollkopf et al. | 187/247 |
| 5,509,505 | A | * | 4/1996 | Steger et al. | 187/394 |
| 5,616,895 | A | | 4/1997 | Spiess | |
| 5,950,767 | A | | 9/1999 | Kamani | 187/335 |
| 6,050,369 | A | * | 4/2000 | Leone et al. | 187/392 |
| 6,056,088 | A | * | 5/2000 | Gerstenkorn | 187/247 |

FOREIGN PATENT DOCUMENTS

| | | |
|---|---|---|
| BE | 563 315 | 1/1958 |
| EP | 897 892 | 2/1999 |

* cited by examiner

*Primary Examiner*—Jonathan Salata
(74) *Attorney, Agent, or Firm*—Cohen, Pontani, Lieberman & Pavane

(57) ABSTRACT

A system for monitoring an elevator door in a hoistway. The elevator door is movable between a closed position and an open position. The system includes a transmitter for emitting an optical signal and an interlock device for latching the elevator door. The interlock device includes an optical nosepiece so positioned for receiving, guiding, and outputting the optical signal from the transmitter when the elevator door is closed and the interlock device is in the latched state. A receiver receives the optical signal via the nosepiece only when the elevator door is closed and the interlock is latched to thereby indicate the elevator door is in its latched state.

26 Claims, 3 Drawing Sheets

OPTICAL MONITORING SYSTEM FOR HOISTWAY DOOR INTERLOCKS

BACKGROUND OF THE INVENTION

1. Field of the Invention

The present invention relates to elevator door safety systems and, in particular, to a method and an apparatus for optically monitoring door interlocks in a hoistway.

2. Description of the Related Art

To prevent people from accidentally falling into an elevator shaft or hoistway of a building, as when an elevator door is opened and no elevator cab is positioned to receive passengers, safety systems must be employed to monitor the latch states of each door in the hoistway. Prior art safety systems utilize electrical contacts arranged to engage a conductive nosepiece of each door interlock device to sense the latch states of each door. The use of electric contacts requires precise alignment of the nosepiece. The electrical contacts experience wear from repeated contact engagement with the nosepiece. Therefore, periodic adjustments and maintenance of the nosepiece is required because of the significant wear which results from the door closing forces during use. The electrical contacts are subject to oxidation which may cause the electrical contacts to falsely report failures. In another failure mode, a broken conductor from the nose piece may lay across two contacts, thereby falsely reporting a latched state of the door.

Accordingly, there is a need for a safety system for monitoring the latch states of an elevator door in a hoistway, which overcomes the disadvantages of prior art systems.

SUMMARY OF THE INVENTION

An object of the present invention is to provide an apparatus for optically monitoring the latch states of an interlock device for an elevator door in a hoist way.

According to one aspect of the invention, a nosepiece of a door interlock device includes an optical input, an optical output, and an optical conduit disposed within the nosepiece for guiding an optical signal from the optical input to the optical output therethrough. The optical input and output are arranged at an angle from each other on the nosepiece so that the optical signal is transmitted therethrough only when the nosepiece is oriented within an acceptable level of tolerance with respect to corresponding optical input/output. In the preferred embodiment, the optical input is arranged perpendicular to the optical output.

According to another aspect of the invention, the nosepieces of a plurality of door interlock devices are connected in series between an optical transmitter and an optical receiver. When each of the door interlock devices is in a closed position or latched state, the receiver receives an optical signal from the optical transmitter. When one of the door interlock devices is in an open position or unlatched state, the receiver does not receive an optical signal from the transmitter.

In one embodiment, the elevator door is movable between a closed state and an open state. The inventive system includes a transmitter for emitting an optical signal and an interlock device for latching the elevator door when the elevator door is closed. The interlock device includes an optical nosepiece so positioned for receiving, guiding, and outputting the optical signal from the transmitter when the elevator door is closed and the interlock device is in the latched state. A receiver receives the optical signal from the nosepiece only when the elevator door is closed and the interlock device is latched to thereby indicate the elevator door is in its latched state.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements.

DETAILED DESCRIPTION OF THE PRESENTLY PREFERRED EMBODIMENTS

Figure 1:
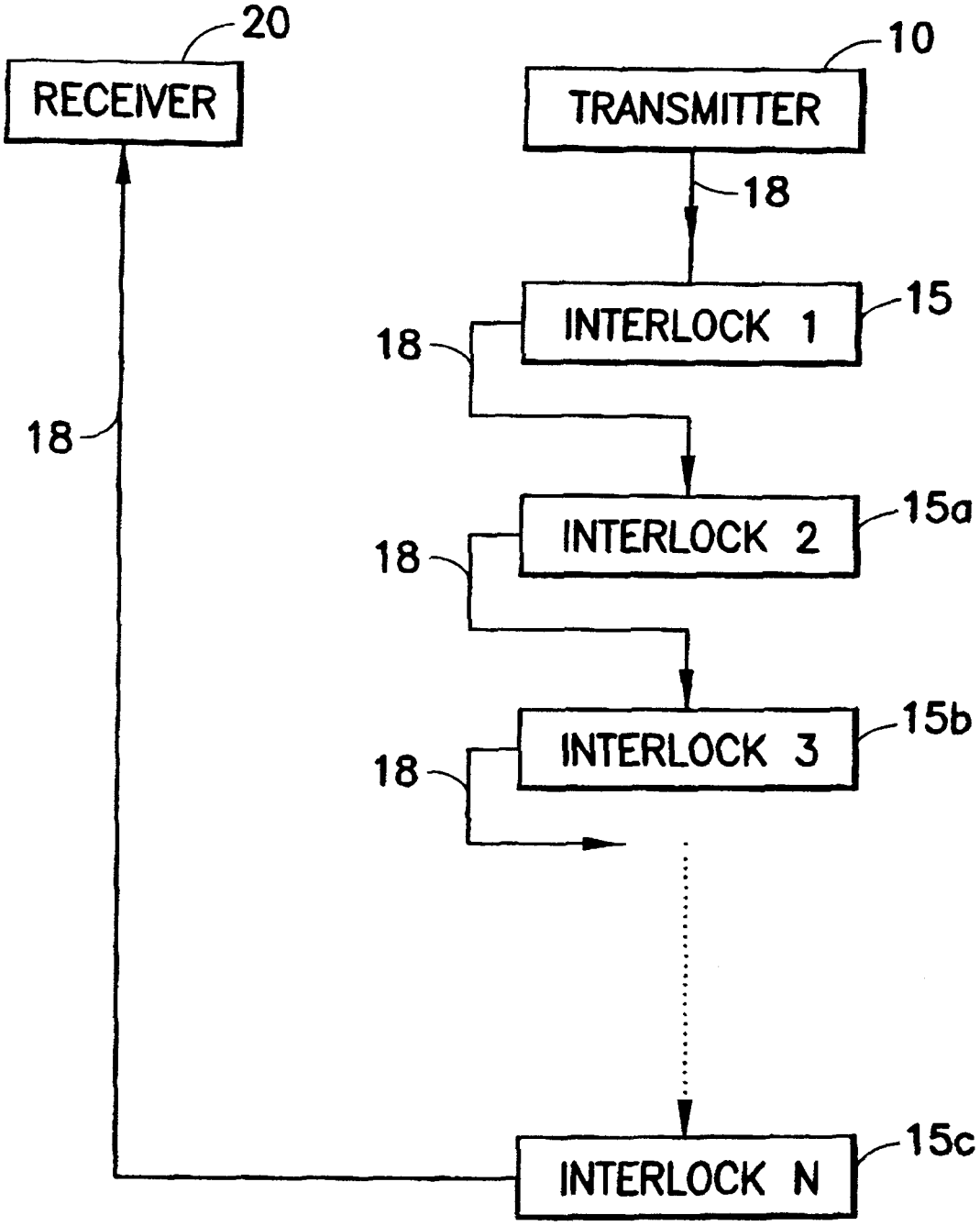
FIG. 1 is a schematic diagram showing an optical hoistway door interlock system according to an embodiment of the present invention.

FIG. 1 illustrates a system for optically monitoring the latch state of an interlock device of each elevator door in a hoistway in accordance with an embodiment of the present invention. The system includes an optical transmitter 10, an optical receiver 20, a plurality of door interlock devices 15, 15*a*, 15*b*, 15*c* (one for each elevator door in the hoistway), and an optical conduit 18 for transmitting optical signals through the plurality of door interlock devices. Preferably, the plurality of door interlock devices are connected, through the optical conduit, in series such that when all the doors in the hoistway are closed, optical signals can be transmitted from the optical transmitter 10, through each of the door interlock devices 15, 15*a*, 15*b*, 15*c* to the optical receiver 20.

The optical transmitter 10 emits an optical signal (e.g., an infrared light beam, a monochromatic laser light beam, etc.) for transmission through the optical conduit 18. The optical receiver 20 receives the optical signal from the optical transmitter through the optical conduit 18, provided there is no open or breakage in optical transmission in the optical conduit.

Each interlock device 15, 15*a*, 15*b*, 15*c* is configured to provide mechanical locking for each door in the hoistway. Advantageously, each interlock device includes an optical nosepiece, connected to a latching member of the interlock device, for indicating the latch states (i.e., open or close positions) of the interlock device. The optical nosepiece is configured to guide an optical signal and serves as an optical ON/OFF switch in the optical conduit. Thus, when the interlock device is in a latched state (i.e., the latching member is in the closed position), the optical nosepiece communicates an optical signal from an upstream interlock device to a downstream interlock device. On the other hand, when the interlock device is in an unlatched state (i.e., the latching member is in the open position), the optical nosepiece breaks the optical conduit so that no optical signal can be transmitted therethrough.

Figure 2:
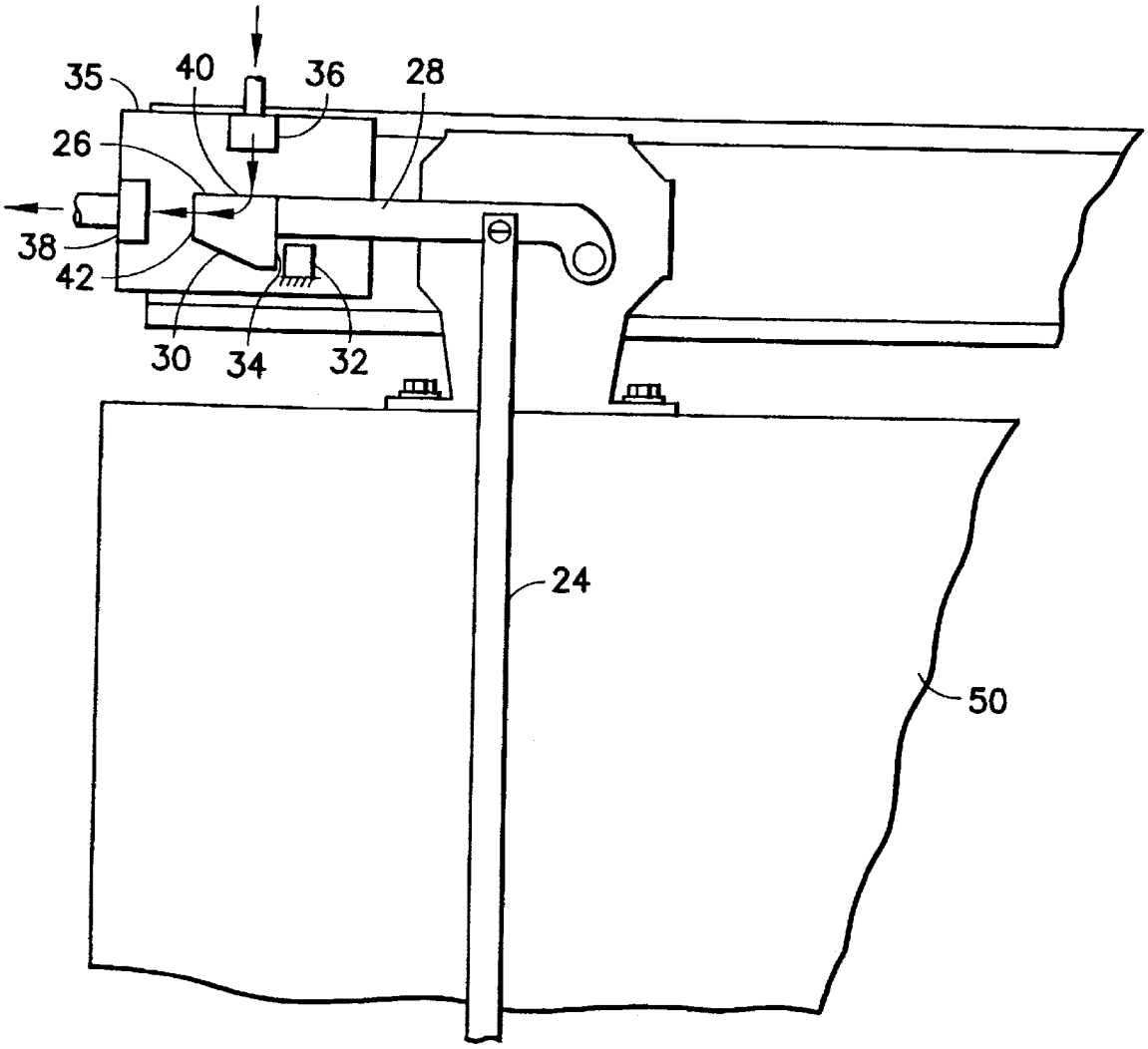
FIG. 2 is a partial sectional view of a door interlock apparatus according to an embodiment of the present invention.

FIG. 2 is a more detailed view of the door interlock device 15 including an optical nosepiece 26. The embodiment of the interlock device 15 shown in FIG. 2 is a specific example of a mechanical interlock which may be used in the present invention. However, the present invention is not limited to this specific embodiment and may include other mechanical interlocks for elevator doors. As shown, the interlock device 15 is in its closed or latched state. The door interlock device 15 includes the optical nosepiece 26 and a latching member 28 connected to the nosepiece. The latching member 28 is pivotally connected to a hoistway door 50. As the hoistway door 50 moves from an open position to a closed position, the latching member 28 moves toward its latched state or closed state. The nosepiece 26 has a ramp surface 30 arranged so that before the latched position is reached, the ramp surface 30 of the nosepiece 26 slides against a stop 32 to thereby lift the latching member 28. When the door 50 is closed and the latching member 28 reaches the closed state, the stop 32 and a corresponding latching surface 34 of the latching member 28 engage to prevent the door 50 from being inadvertently opened. The latching member 28 is further connected to a latch arm 24, driven by an automatic drive mechanism (not shown), for moving the latching member 28 out of locking engagement with the stop 32 when the elevator arrives at the floor corresponding to the door 50 and the door is required to open for discharging or receiving passengers or a load. Once the door interlock device 15 is in its latched state, the nosepiece 26 transmits optical signals from an incoming connection 36 of the optical conduit 18 to an outgoing connection 38 of the optical conduit 18.

The nosepiece 26 is designed so that light is allowed to enter through an incoming surface area 40 on the top of the nose piece 26 and exit from an outgoing surface area 42 on a side of the nosepiece 26. Whenever the nosepiece is within a reasonable tolerance with respect to the latched state, i.e., the incoming surface area 40 and the outgoing surface area 42 are respectively aligned with the incoming connection 36 and the outgoing connection 38, so that light is allowed through the nosepiece 26 to the optical receiver 20, the interlock device 15 is considered to be in the closed state.

As shown in FIG. 1, the incoming connection 36 and the outgoing connection 38 are connected to an interlock box 35 in which the stop 32 is mounted. Accordingly, as the latched position is approached, the nose piece 26 enters the interlock box 35 to engage the stop 32. The latching mechanism 15 and interlock box 35 may comprise standard designs already in use such as, for example, those door interlock devices and boxes manufactured by GAL and ECI. The use of standard designs obviates the requirement to redesign the elevator entrance to accommodate new designs, which would require the difficult and lengthy task of obtaining UL, CSA and NEC approval.

In addition, the interlock box 35 has sufficient depth, length, and width dimensions with respect to the dimensions of the nose piece 26 so that in the event of a failure in which the nose piece 26 or a part of the nose piece 26 becomes disconnected from the latching member, the broken part falls below the outgoing connection 38, thereby preventing the latched signal from being transmitted through the broken part.

The interlock device 15 of FIG. 2 tolerates large losses and attenuation of the optical signal because the optical conduit 18 is not carrying data. Rather, the presence or absence of light are all that is detected by the optical receiver 20. To increase the tolerance for alignment, the area of the aperture of the outgoing connection 38 is greater than the area of the outgoing surface area 42 of the nosepiece 26. At the same time, the latched state of the nosepiece 26 is reliably ascertained because the incoming connection 36 is perpendicular to the outgoing connection 38, thereby requiring a specific three-dimensional orientation of the nosepiece 26. This configuration prevents inadvertent "closed" signals by requiring that both surfaces be aligned.

Figure 3A:
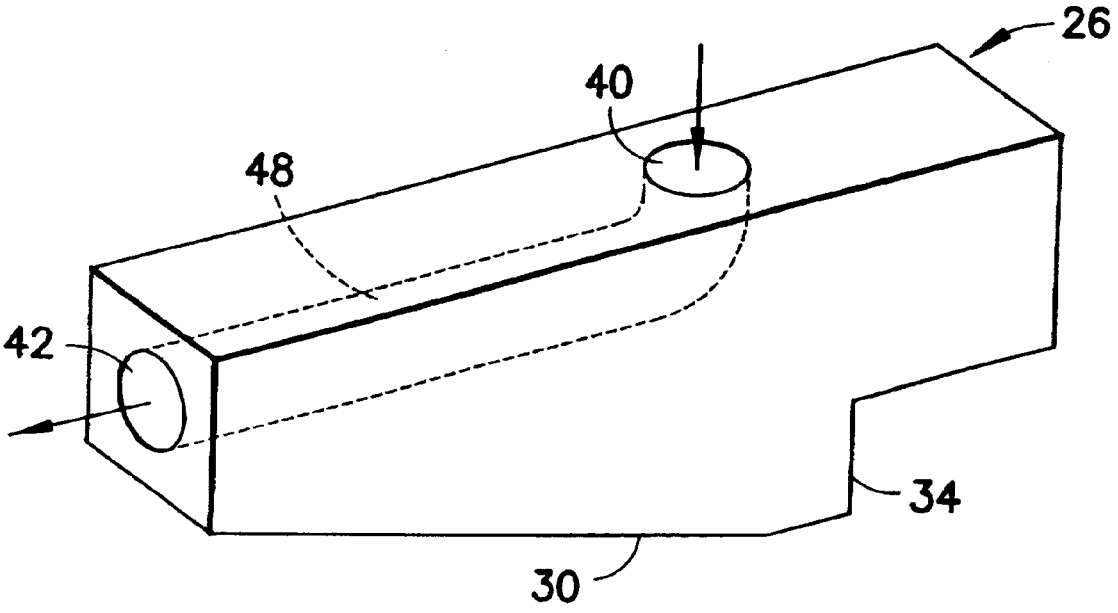
FIG. 3*a* is a perspective view of an optical nosepiece of the door interlock apparatus of FIG. 2.
Figure 3B:
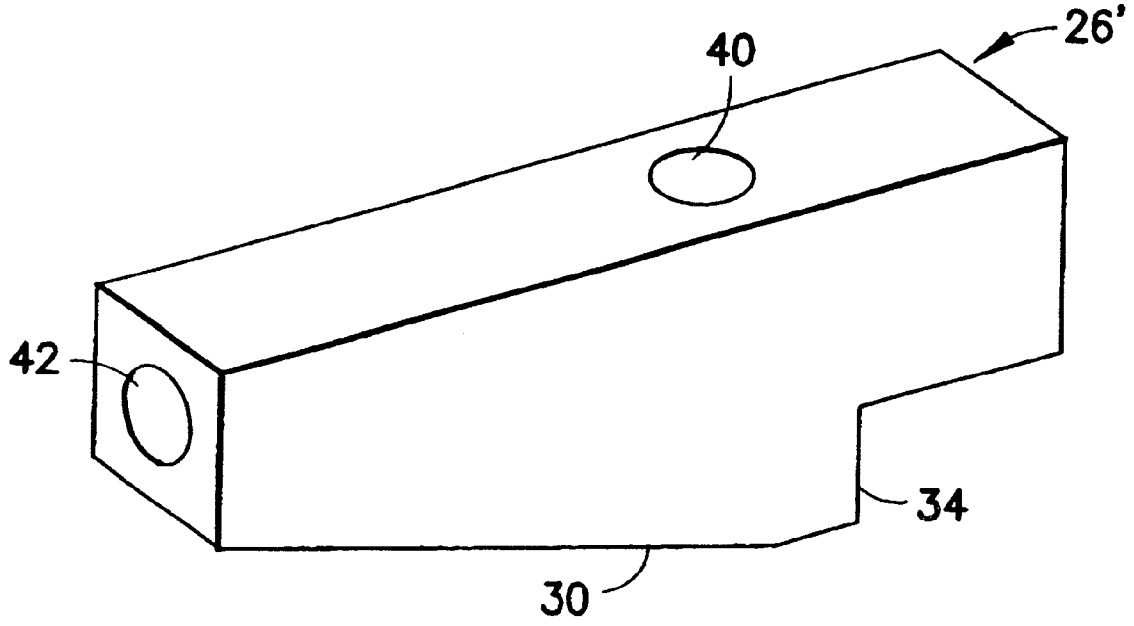
FIG. 3*b* is a perspective view of a further embodiment of an optical nosepiece according to the present invention.

FIG. 3*a* is an exemplary construction of the nosepiece 26. As can be readily seen, the incoming surface are 40 and the outgoing surface area 42 of the nosepiece 26 are oriented at an angle from each other. The angle is preferably a right angle but may be any angle required by a specific application. A light guide 48 extends from the incoming surface area 40 to the outgoing surface area 42 through the body of the nosepiece 26. The light guide 48 may be formed of a light-transmitting fiber as shown in FIG. 3*a*. In an alternative embodiment shown in FIG. 3*b*, the nosepiece 26' comprises a reflective tunnel in which the walls of the nosepiece 26' are internally reflective which creates a reflective tunnel therein. The reflective walls may be formed by applying a reflective film coated on the tunnel side wall. In this alternative embodiment, the outside surface of the nosepiece is preferably opaque so that if the nosepiece becomes misaligned with the incoming connection 36 or outgoing connection 38 of the optical conduit 18, light from the optical conduit will be absorbed by the nosepiece 26' rather than reflected back into the nosepiece 26'.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A system for monitoring an elevator door in a hoistway, the elevator door being movable between an open position and a closed position, said system comprising:

an optical conduit having a first end and a second end;

a transmitter operatively arranged at said first end of said optical conduit for transmitting an optical signal into said first end of said optical conduit;

a receiver operatively arranged at said second end of said optical conduit for receiving the optical signal from said optical conduit; and an interlock device having a movable latching member for latching the elevator door in the closed position when said interlock device is in a latched state, said optical conduit further comprising an incoming connection to said interlock device and an outgoing connection to said interlock device, wherein said interlock device further comprises an optical nosepiece arranged for guiding the optical signal from said incoming connection to said outgoing connection when said interlock device is in said latched state, said incoming connection facing a first direction and said outgoing connection facing a second direction, said first direction being arranged at an angle to said second direction.

2. The system of claim 1, wherein said first direction is perpendicular to said second direction.

3. The system of claim 1, wherein said optical nosepiece comprises an incoming surface for receiving the optical signal and an outgoing surface facing said outgoing connection, wherein said incoming surface is arranged on a top of said nosepiece and said outgoing surface is arranged on a side of said nosepiece.

4. The system of claim 3, wherein said first direction is perpendicular to said second direction.

5. The system of claim 1, wherein said optical nosepiece comprises an incoming surface for receiving the optical signal and an outgoing surface facing said outgoing connection, wherein an area of said outgoing connection is greater than an area of said outgoing surface.

6. The system of claim 5, wherein said incoming surface is arranged on a top of said nosepiece and said outgoing surface is arranged on a side of said nosepiece.

7. The system of claim 6, wherein said first direction is perpendicular to said second direction.

8. The system of claim 1, wherein said optical nosepiece comprises an incoming surface for receiving the optical signal and an outgoing surface facing said outgoing connection and said nose piece comprises a light guide comprising a light transmitting fiber for connecting the incoming surface area to said outgoing surface area.

9. The system of claim 1, wherein said optical nosepiece comprises an incoming surface for receiving the optical signal and an outgoing surface facing said outgoing connection and said nose piece comprises a reflective tunnel for connecting the incoming surface area to said outgoing surface area.

10. The system of claim 9, wherein reflective tunnel comprises tunnel side walls and a reflective film coated on said tunnel side walls.

11. The system of claim 1, wherein said interlock device comprises an interlock box to which said incoming connection and said outgoing connection are connected, wherein said optical nose piece is arranged in said interlock box when said interlock device is in said latched state.

12. The system of claim 11, wherein said movable latching member and said interlock box are standard devices.

13. The system of claim 11, wherein said nose piece has a failure mode in which one of said nose piece and a part of said nose breaks away from said movable latching member in said interlock box, and wherein said incoming connection and said outgoing connection are arranged on said interlock box such that said one of said nose piece and a part of said nose piece that breaks away from said movable latching member is permitted to fall below said incoming connection and said outgoing connection, thereby preventing transmission of the optical signal through said one of said one of said nose piece and a part of said nose piece during said failure mode.

14. A system for monitoring elevator doors in a hoistway, each of the elevator doors being movable between an open position and a closed position, said system comprising:

an optical conduit having a first end and a second end;

a transmitter operatively arranged at said first end of said optical conduit for transmitting an optical signal into said first end of said optical conduit;

a receiver operatively arranged at said second end of said optical conduit for receiving the optical signal from said optical conduit; and a plurality of interlock devices, each of said plural interlock devices having a movable latching member for latching one of the elevator doors in the closed position when said interlock device is in a latched state, said optical conduit further comprising an incoming connection to said each of said plural interlock devices and an outgoing connection to said each of said plural interlock devices, wherein said each of said plural interlock devices further comprises an optical nosepiece arranged for guiding the optical signal from said incoming connection to said outgoing connection when said each of said interlock devices is in said latched state, said incoming connection facing a first direction and said outgoing connection facing a second direction, said first direction being arranged at an angle to said second direction.

15. The system of claim 14, wherein said first direction is perpendicular to said second direction.

16. The system of claim 14, wherein said optical nosepiece comprises an incoming surface for receiving the optical signal and an outgoing surface facing said outgoing connection, wherein said incoming surface is arranged on a top of said nosepiece and said outgoing surface is arranged on a side of said nosepiece.

17. The system of claim 15, wherein said first direction is perpendicular to said second direction.

18. The system of claim 14, wherein said optical nosepiece comprises an incoming surface for receiving the optical signal and an outgoing surface facing said outgoing connection, wherein an area of said outgoing connection is greater than an area of said outgoing surface.

19. The system of claim 18, wherein said incoming surface is arranged on a top of said nosepiece and said outgoing surface is arranged on a side of said nosepiece.

20. The system of claim 19, wherein said first direction is perpendicular to said second direction.

21. The system of claim 14, wherein said optical nosepiece comprises an incoming surface for receiving the optical signal and an outgoing surface facing said outgoing connection and said nose piece comprises a light guide comprising a light transmitting fiber for connecting the incoming surface area to said outgoing surface area.

22. The system of claim 14, wherein said optical nosepiece comprises an incoming surface for receiving the optical signal and an outgoing surface facing said outgoing connection and said nose piece comprises a reflective tunnel for connecting the incoming surface area to said outgoing surface area.

23. The system of claim 22, wherein reflective tunnel comprises tunnel side walls and a reflective film coated on said tunnel side walls.

24. The system of claim 14, wherein said interlock device comprises an interlock box to which said incoming connection and said outgoing connection are connected, wherein said optical nose piece is arranged in said interlock box when said interlock device is in said latched state.

25. The system of claim 24, wherein said movable latching member and said interlock box are standard devices.

26. The system of claim 24, wherein said nose piece has a failure mode in which one of said nose piece and a part of said nose breaks away from said movable latching member in said interlock box, and wherein said incoming connection and said outgoing connection are arranged on said interlock box such that said one of said nose piece and a part of said nose piece that breaks away from said movable latching member is permitted to fall below said incoming connection and said outgoing connection, thereby preventing transmission of the optical signal through said one of said one of said nose piece and a part of said nose piece during said failure mode.

* * * * *